US012624461B2

(12) United States Patent
Müller

(10) Patent No.: US 12,624,461 B2
(45) Date of Patent: May 12, 2026

(54) PROCESS AND APPARATUS FOR SYNTHESIS OF AMMONIA

(71) Applicant: Forschungszentrum Jülich GmbH, Jülich (DE)

(72) Inventor: Martin Müller, Sinzig (DE)

(73) Assignee: Forschungszentrum Jülich GmbH, Jülich (DE)

( * ) Notice: Subject to any disclaimer, the term of this patent is extended or adjusted under 35 U.S.C. 154(b) by 878 days.

(21) Appl. No.: 17/913,370

(22) PCT Filed: Feb. 11, 2021

(86) PCT No.: PCT/EP2021/053371
§ 371 (c)(1),
(2) Date: Sep. 21, 2022

(87) PCT Pub. No.: WO2021/197699
PCT Pub. Date: Oct. 7, 2021

(65) Prior Publication Data

US 2023/0332303 A1 Oct. 19, 2023

(30) Foreign Application Priority Data

Apr. 1, 2020 (DE) ..... 10 2020 109 016.1

(51) Int. Cl.
*C25B 1/00* (2021.01)
*C25B 1/27* (2021.01)
(Continued)

(52) U.S. Cl.
CPC ..... *C25B 1/27* (2021.01); *C25B 9/23* (2021.01); *C25B 9/70* (2021.01); *C25B 11/081* (2021.01); *C25B 11/091* (2021.01); *C25B 15/087* (2021.01)

(58) Field of Classification Search
CPC ..... C25B 1/27; C25B 11/081; C25B 9/70; C25B 15/087; C25B 9/23; C25B 11/091
See application file for complete search history.

(56) References Cited

U.S. PATENT DOCUMENTS

2012/0241328 A1* 9/2012 Joshi ..... C25B 13/04 205/552
2019/0363386 A1* 11/2019 Wakita ..... C25B 15/02
(Continued)

FOREIGN PATENT DOCUMENTS

DE 1220401 B 7/1966
WO WO2019072608 A1 4/2019

OTHER PUBLICATIONS

Yuko Fujita et al. "An electrochemical oxygen separator using an ion exchange membrane as the electrolyte", Journal of Applied Electrochemistry, Springer, Dordrecht, NL, vol. 16, No. 6, Nov. 1, 1986 (Nov. 1, 1986), pp. 935-940; DOI: 10.1007/BF01006541; ISSN: 0021-891X, XP000567790.
(Continued)

*Primary Examiner* — Zulmariam Mendez
(74) *Attorney, Agent, or Firm* — CALDERON SAFRAN & WRIGHT P.C.

(57) ABSTRACT

A process and system for synthesis of ammonia includes an electrochemical main cell and an electrochemical preliminary cell upstream of the main cell. A voltage is applied between the anode and cathode of the preliminary cell and the main cell. The anodic half-cell of the preliminary cell is supplied with water, and the cathodic half-cell of the preliminary cell with nitrogen and oxygen. Oxygen is in the anodic half-cell of the preliminary cell, and nitrogen and water are in the cathodic half-cell of the preliminary cell. The anodic half-cell of the main cell is supplied with water, and the cathodic half-cell of the main cell with nitrogen that has been obtained in the cathodic half-cell of the preliminary
(Continued)

cell. Oxygen is in the anodic half-cell of the main cell, and ammonia in the cathodic half-cell of the main cell.

20 Claims, 2 Drawing Sheets

(51) Int. Cl.

| | |
|---|---|
| ***C25B 9/23*** | (2021.01) |
| ***C25B 9/70*** | (2021.01) |
| ***C25B 11/081*** | (2021.01) |
| ***C25B 11/091*** | (2021.01) |
| ***C25B 15/08*** | (2006.01) |

(56) References Cited

U.S. PATENT DOCUMENTS

2019/0382903 A1 12/2019 Johanning et al.
2020/0316519 A1* 10/2020 Pess ..... C02F 9/00

OTHER PUBLICATIONS

Kugler, Kurt, "Electrochemical Nitrogen Reduction for Ammonia Synthesis" Dissertation by Kurt Kugler, Faculty of Mechanical Engineering at RWTH Aachen University, HBZ: HT018996649, published in 2016 on the publication server of RWTH Aachen University.

V. Kordali et al. "Electrochemical synthesis of ammonia at atmospheric pressure and low temperature in a solid polymer electrolyte cell", Chemical Communications, No. 17, Jan. 1, 2000 (Jan. 1, 2000), pp. 1673-1674; DOI: 10.1039/b004885m; ISSN: 1359-7345, XP055461238.

Gomez Jamie R et al. "Techno-economic analysis and life cycle assessment for electrochemical ammonia production using proton conducting membrane", International Journal of Hydrogen Energy, Elsevier Science Publishers B. V., Barking, GB, vol. 45, No. 1, Nov. 21, 2019 (Nov. 21, 2019), pp. 721-737; DOI: 10.1016/J.IJHYDENE.2019.10.174; ISSN: 0360-3199, XP085968715.

* cited by examiner

PROCESS AND APPARATUS FOR SYNTHESIS OF AMMONIA

CROSS-REFERENCE TO RELATED APPLICATIONS AND CLAIM TO PRIORITY

This application is a national stage application of International Application No. PCT/EP2021/053371 filed Feb. 11, 2021, which claims priority to German Patent Application No. 10 2020 109 016.1 filed Apr. 1, 2020, the disclosures of which are incorporated herein by reference and to which priority is claimed.

FIELD OF THE INVENTION

The invention relates to a method for synthesis of ammonia, wherein an electrochemical main cell comprising an anodic half-cell with an anode and a cathodic half-cell with a cathode is provided, wherein a membrane, in particular a cation exchange membrane, is arranged between the anodic and the cathodic half-cell, through which protons can pass from the anodic into the cathodic half-cell, and wherein the anode comprises at least one catalyst material, in particular iridium and/or ruthenium and/or platinum, and the cathode comprises at least one catalyst material, in particular ruthenium and/or titanium and/or iron, preferably ruthenium and titanium and iron.

Furthermore, the invention relates to an apparatus for synthesis of ammonia, comprising an electrochemical main cell comprising an anodic half-cell with an anode and a cathodic half-cell with a cathode, wherein a membrane, in particular a cation exchange membrane, is arranged between the anodic half-cell and the cathodic half-cell, through which protons can pass from the anodic into the cathodic half-cell, and wherein the anode comprises at least one catalyst material, in particular iridium and/or ruthenium and/or platinum, and the cathode comprises at least one catalyst material, in particular ruthenium and/or titanium and/or iron, preferably ruthenium and titanium and iron, and means for providing a voltage between the anode and the cathode.

BACKGROUND OF THE INVENTION

Ammonia ($NH_3$) represents a very important chemical which is used, among other things, as a fertilizer. For the production of ammonia, the Haber-Bosch method is known, which is a large-scale industrial chemical method. In this method, named after Fritz Haber and Carl Bosch, ammonia is synthesized from atmospheric nitrogen and hydrogen on a catalyst containing iron at high pressures and high temperatures. The pressure can be in the range of 150 to 350 bar in particular and the temperature in the range of 400 to 500° C. in particular. Almost all annual ammonia production is currently carried out using the Haber-Bosch method.

It is sometimes considered a disadvantage that ammonia production via this method is only possible on an industrial scale and is characterized by comparatively high energy consumption and $CO_2$ emissions.

In the dissertation "Electrochemical Nitrogen Reduction for Ammonia Synthesis" by Kurt Kugler, Faculty of Mechanical Engineering at RWTH Aachen University, HBZ: HT018996649, published in 2016 on the publication server of RWTH Aachen University, it is proposed to perform an electrochemical ammonia synthesis in an electrochemical cell. The cell comprises two halves, namely an anodic and a cathodic half-cell, separated by a membrane, specifically a cation exchange membrane. In the dissertation, the electrochemical cell comprising a membrane is referred to as an electrochemical membrane reactor.

The anodic half-cell comprises an anode and the cathodic half-cell comprises a cathode. Both the anode and the cathode are in the form of an electrode structure, each of which comprises at least one catalyst material. The anode and the cathode are in contact with opposite sides of the membrane. Specifically, they are pressed onto opposite sides of the membrane.

The catalyst material proposed for the anode for water oxidation in the dissertation is iridium (Ir), specifically an iridium mixed metal oxide (IrMMO) catalyst. H+ required for ammonia synthesis can thus be produced in an environmentally friendly manner by water oxidation at the anode and pass through the membrane to the cathode. Titanium (Ti), iron (Fe) and ruthenium (Ru) were also selected as potential catalyst materials.

For ammonia synthesis, a voltage is applied between the anode and the cathode and water vapor ($H_2O$) is supplied to the anode and nitrogen ($N_2$) is supplied to the cathode, which was obtained by cryogenic air separation. Oxygen ($O_2$) is obtained at the anode and ammonia ($NH_3$) at the cathode. It is proposed to use renewable energy, such as solar or wind energy, for the voltage supply of the electrochemical cell, so that the method can be particularly sustainable and environmentally friendly.

The method for ammonia synthesis proposed in the dissertation "Electrochemical Nitrogen Reduction for Ammonia Synthesis" has great potential. However, there is still a need to improve the sustainability and environmental friendliness of ammonia production.

SUMMARY OF THE INVENTION

It is therefore an object of the present invention to further develop a method for ammonia synthesis of the type described above in such a way that it is characterized by a particularly high degree of sustainability and environmental friendliness and at the same time can be carried out with reasonable effort. Furthermore, it is an object of the invention to provide an apparatus for carrying out such a method.

The first object is solved in a method of the kind mentioned above in that an electrochemical pre-cell, which is connected upstream of the main cell and which comprises an anodic half-cell with an anode and a cathodic half-cell with a cathode, is provided, wherein a membrane, in particular a cation exchange membrane, is arranged between the anodic half-cell and the cathodic half-cell, through which protons can pass from the anodic into the cathodic half-cell, and wherein the anode comprises at least one catalyst material, in particular iridium and/or ruthenium, and the cathode comprises at least one catalyst material, in particular platinum, a voltage is applied between the anode and cathode of the pre-cell pre-cell voltage, and a voltage is applied between the anode and cathode of the main cell, main cell voltage, water is supplied to the anodic half-cell of the pre-cell and nitrogen and oxygen, in particular air, are supplied to the cathodic half-cell of the pre-cell, oxygen is obtained in the anodic half-cell of the pre-cell and nitrogen and water are obtained in the cathodic half-cell of the pre-cell, water, in particular vaporous water, is supplied to the anodic half-cell of the main cell, and nitrogen obtained in the cathodic half-cell of the pre-cell is supplied to the cathodic half-cell of the main cell, and oxygen is obtained in the anodic half-cell of the main cell, and ammonia is obtained in the cathodic half-cell of the main cell.

The second object is solved in an apparatus of the kind mentioned above in that the apparatus further comprises an electrochemical pre-cell connected upstream of the main cell, which comprises an anodic half-cell with an anode and a cathodic half-cell with a cathode, wherein a membrane, in particular a cation-exchange membrane, is arranged between the anodic half-cell and the cathodic half-cell, through which protons can pass from the anodic into the cathodic half-cell, and wherein the anode comprises at least one catalyst material, in particular iridium and/or ruthenium, and the cathode comprises at least one catalyst material, in particular platinum, pre-cell voltage means for providing a voltage between the anode and cathode of the pre-cell, and fluid connection means for fluidically connecting the cathodic half-cell (6) of the pre-cell to the cathodic half-cell of the main cell.

The apparatus according to the invention has been found to be particularly suitable for carrying out the method according to the invention.

In other words, the invention is based on the idea of providing the nitrogen, which is to be supplied to the cathodic half-cell for the ammonia synthesis in an electrochemical cell, by means of a further electrochemical cell, to which in turn water as well as nitrogen together with oxygen, in particular in the form of air, can be supplied as input or supply materials. By means of the cathode of the pre-cell, nitrogen and water can be obtained from a mixture with nitrogen and oxygen, in particular air. It can also be said that the pre-cell comprises an oxygen consuming cathode. As a result, ammonia synthesis from air and water becomes possible using electrochemical cells.

As a result, a costly separate method for nitrogen production from air, in particular cryogenic air separation, can be dispensed with. The overall method requires comparatively little design and energy. The method according to the invention enables a particularly environmentally friendly, sustainable ammonia production, especially when coupled with renewable energy sources.

Nitrogen and water or water vapor are very easy to separate from each other. For example, the water can be separated from the nitrogen and water leaving the cathodic half-cell of the pre-cell, in particular by means of a cooling and/or separation device provided between the pre-cell and the main cell. Accordingly, in an advantageous further development, the apparatus according to the invention comprises a cooling and/or separating device connected upstream of the cathodic half-cell of the main cell, so that in particular liquid water can be separated before it reaches the cathodic half-cell of the main cell.

Water is preferably supplied in excess to the anodic half-cell of the main cell. In particular in this case, water will also exit the anodic half-cell of the main cell, so that water and oxygen exit it.

The material supply into the respective anodic and cathodic half-cell of a cell expediently takes place at the same time. This means that water is expediently supplied to the anodic half-cell of the pre-cell and nitrogen and oxygen, in particular in the form of air, are supplied simultaneously to the cathodic half-cell of the pre-cell. Similarly, when water is supplied to the anodic half-cell of the main cell, nitrogen is simultaneously supplied to the cathodic half-cell.

The half-cells of the pre-cell and main cell expediently define an electrically contacted reaction space in their interior. Furthermore, they are expediently designed in such a way that the starting substances or materials be fed can be fed to them, in particular in a gaseous and/or liquid state, for which purpose they preferably each have at least one inlet, and in such a way that the reaction products contained therein can exit from them, for which purpose they preferably each have at least one outlet.

The cathode and anode of the half-cells of the pre-cell and main cell are preferably each provided by or comprise a porous, electrically and ionically conductive and catalytically active electrode structure. The anode and the cathode of the respective cell are expediently in contact with opposite sides of the membrane. They are preferably pressed onto opposite sides of the respective membrane. The electrochemical reactions take place in particular in the area of the contact points.

In an advantageous embodiment, the anode and cathode of the pre-cell and/or main cell each also comprise some of the ion-conducting material of the membrane of the respective cell. This makes it possible to enlarge the reaction zone and increase the performance of the cells.

The anode and cathode of the pre-cell and main cell each have at least one catalyst material that enables the required reactions. It is also possible that a mixture or group of several catalyst materials is present, especially at the cathode of the main cell.

Iridium on the anode side and platinum on the cathode side have proven to be particularly suitable catalyst materials for the pre-cell. In a preferred embodiment, the anode of the pre-cell comprises iridium as the sole catalyst material and the cathode of the pre-cell comprises platinum as the preferred catalyst material.

Regarding the main cell, iridium has also proven to be a suitable catalyst material for the anode. Again, in an advantageous embodiment, the anode comprises iridium as the sole catalyst material.

It is also possible that the anode of the main cell comprises platinum preferably as the single catalyst material. This particularly, if at least one intermediate electrochemical cell is provided, which will be discussed further below.

Regarding the cathode of the main cell, it has proven to be particularly suitable if a combination of several catalyst materials is present. Particularly preferably, the cathode of the main cell comprises ruthenium and titanium and iron as catalyst materials.

The membrane present in both the pre-cell and the main cell is preferably designed as a cation exchange membrane. In particular, it is a proton-conducting membrane. The membrane enables the required protons to pass from the anode of the anodic half-cell to the cathode of the cathodic half-cell. For example, the membrane of the pre-cell and/or the membrane of the main cell may comprise or consist of nafion.

It may be provided that water taken from the anodic half-cell of the pre-cell is supplied to the anodic half-cell of the main cell. In particular, it may be water that has been supplied in excess to the anodic half-cell of the pre-cell. Further preferably, water is supplied to the anodic half-cell of the main cell in a liquid state.

The apparatus according to the invention can have fluid connection means for fluidically connecting the anodic half-cell of the pre-cell to the anodic half-cell of the main cell. This is particularly useful if no further electrochemical cell is arranged between the pre-cell and the main cell, or if no further electrochemical cells are arranged. The anodic half-cell of the main cell can be fed directly with water from the anodic half-cell of the pre-cell then.

A further exemplary embodiment of the method according to the invention is characterized in that an intermediate cell, which is connected downstream of the pre-cell and upstream of the main cell and which comprises an anodic half-cell with an anode and a cathodic half-cell with a cathode, is provided, wherein a membrane, in particular a cation exchange membrane, is arranged between the anodic half-cell and the cathodic half-cell, through which protons can pass from the anodic into the cathodic half-cell, and wherein the anode comprises at least one catalyst material, in particular iridium and/or ruthenium, and the cathode comprises at least one catalyst material, in particular platinum, and a voltage is applied between the anode and cathode of the intermediate cell, intermediate cell voltage, and water is supplied to the anodic half-cell of the intermediate cell, in particular water which was obtained in the anodic half-cell of the pre-cell, and preferably no substances are supplied to the cathodic half-cell of the intermediate cell, and oxygen is obtained in the anodic half-cell of the intermediate cell, and hydrogen and permeating water are obtained in the cathodic half-cell of the intermediate cell, and hydrogen and water obtained in the cathodic half-cell of the intermediate cell are supplied to the anodic half-cell of the main cell, the water particularly being supplied in the vaporized state.

The inventive apparatus can accordingly in further development be characterized in that the anode of the main cell preferably comprises platinum as catalyst material, and the apparatus further comprises an intermediate cell which is connected downstream of the pre-cell and upstream of the main cell, and which comprises an anodic half-cell with an anode and a cathodic half-cell with a cathode, wherein a membrane, in particular a cation exchange membrane, is arranged between the anodic half-cell and the cathodic half-cell, through which protons can pass from the anodic into the cathodic half-cell, and where the anode comprises at least one catalyst material, in particular iridium and/or ruthenium, and the cathode comprises at least one catalyst material, in particular platinum, and intermediate cell voltage means for providing a voltage between the anode and cathode of the intermediate cell, fluid connection means for fluidically connecting the anodic half-cell of the pre-cell to the anodic half-cell of the intermediate cell, fluid connection means for fluidically connecting the cathodic half-cell of the intermediate cell to the anodic half-cell of the main cell.

In these embodiments, three electrochemical cells connected in series are used, with the intermediate cell serving to feed the anodic half-cell of the main cell with hydrogen and water, while the cathodic half-cell of the main cell is fed with nitrogen from the cathodic half-cell of the pre-cell, as in the constellation without intermediate cell. The advantage is that the main cell can then be operated at lower voltages and also at lower temperatures, which increases the ammonia yield.

If an intermediate cell is present, its anode and/or its cathode and/or its membrane may in further development be characterized by one or more of the features described above in connection with the pre-cell and main cell as being preferred for these components.

For the intermediate cell it has proved to be particularly suitable if the anode comprises iridium as the preferred sole catalyst material and the cathode comprises platinum as the preferred sole catalyst material.

Preferably, an intermediate cell voltage in the range of 1.2 to 2.5 volts, preferably in the range of 1.48 to 2 volts, is applied between the anode and cathode of the intermediate cell. Accordingly, in the inventive apparatus, the intermediate cell voltage means are preferably designed to provide a voltage in the range of 1.2 to 2.5 volts, preferably in the range of 1.48 to 2 volts.

The operating temperature in the intermediate cell is preferably in the range of 10° C. to 90° C. It generally adjusts itself according to the choice of operating parameters. An intermediate cell, if any, of the apparatus according to the invention is expediently designed for corresponding operating temperatures.

In a further advantageous embodiment, solar energy is used to provide the intermediate cell voltage. The intermediate cell voltage is preferably provided by means of at least one photovoltaic cell. In the apparatus, the intermediate cell voltage means may then comprise at least one photovoltaic cell or be provided by at least one photovoltaic cell.

Regarding the pre-cell voltage, it may further be provided that such a voltage of less than 1.7 volts, preferably of less than 1.48 volts, more preferably of less than 1.23 volts is applied.

Alternatively or additionally, a main cell voltage may be applied in the range of 1 volt to 3 volts, preferably in the range of 1.7 volts to 2.7 volts, more preferably 1.2 volts to 1.3 volts.

Accordingly, the pre-cell voltage means of the inventive apparatus may be adapted to provide a voltage of less than 1.7 volts, preferably less than 1.48 volts, more preferably less than 1.23 volts, and/or the main cell voltage means of the inventive apparatus may be adapted to provide a voltage in the range of 1 to 3 volts, preferably in the range of 1.7 to 2.7 volts, more preferably 1.2 to 1.3 volts.

The operating temperature in the pre-cell is preferably in the range of 10° C. to 90° C. It generally adjusts itself depending on the choice of operating parameters. The pre-cell of the inventive apparatus suitably is designed for corresponding operating temperatures.

The operating temperature in the main cell is preferably in the range from 20° C. to 40° C., in particular in the range from 25° C. to 35° C. It generally adjusts itself depending on the choice of operating parameters. The main cell of the apparatus according to the invention suitably is designed for corresponding operating temperatures.

In an advantageous embodiment, solar energy can also be used for providing the pre-cell voltage and/or for providing the main cell voltage. Here, too, it can be that the pre-cell voltage and/or the main cell voltage is provided by means of at least one photovoltaic cell. It has proven particularly suitable if the pre-cell voltage is provided by a photovoltaic cell associated with the pre-cell and the main cell voltage is provided by a further photovoltaic cell associated with the main cell. If an intermediate cell is present, it preferably has its own, third photovoltaic cell assigned to it, which then provides the intermediate cell voltage.

The pre-cell voltage means of the inventive apparatus can accordingly comprise at least one photovoltaic cell or be provided by at least one photovoltaic cell, and the main cell voltage means comprise at least one photovoltaic cell or be provided by at least one photovoltaic cell.

It has proved to be particularly advantageous if all electrochemical cells, i.e. both the pre-cell and the main cell and, if present, the intermediate cell, are supplied with voltage by means of a photovoltaic cell. In this case, a separate photovoltaic cell is preferably provided for each electrochemical cell. This design makes it possible for the entire voltage supply of the ammonia synthesis method according to the invention to be covered by solar energy alone, which enables a particularly high degree of sustainability. In other words, solar production of ammonia from air and water is possible.

It should be noted that it is of course possible for an inventive apparatus to comprise even more than three electrochemical cells, or for more than three electrochemical cells to be used when carrying out the inventive method. For example, two or more identical cells may be used in each case to enable a higher throughput. This may apply both to the case where no intermediate cell is provided and to the case with an intermediate cell. It may be that both or all three types of cells are present two or more times, or for example only one of the cells.

Another embodiment of the method according to the invention is further characterized in that vaporous water is supplied to the anodic half-cell of the main cell. In particular, an evaporation device upstream of the main cell is used to obtain the vaporous water then. In a particularly advantageous further embodiment, the evaporation device may comprise at least one solar thermal collector or be coupled to at least one solar thermal collector. A solar thermal collector makes it possible to achieve evaporation solely by means of solar energy, which makes the method or apparatus particularly sustainable and environmentally friendly.

In the apparatus, an evaporation device may be provided upstream of the anodic half-cell of the main cell. The evaporation device can on its input side be fluidically connected to the anodic half-cell of the pre-cell. Alternatively or additionally, the evaporation device comprises at least one solar thermal collector.

The at least one solar thermal collector is preferably used to heat a heat transfer medium and transfer heat from this medium to water flowing through the evaporation device. The evaporation device can have a heat transfer medium circuit for constructional implementation.

If the voltage supply for all electrochemical cells is realized by means of photovoltaic cells and at least one solar thermal collector is used for any evaporation that may be provided or required, the complete supply can be obtained with solar energy alone, which has proven to be particularly sustainable and environmentally friendly.

According to a further advantageous embodiment of the method according to the invention, nitrogen obtained in the anodic half-cell of the main cell is fed again to the anodic half-cell of the main cell. Accordingly, the apparatus can have at least one circulation pipe by means of which nitrogen exiting the cathodic half-cell of the main cell can be resupplied to the cathodic half-cell. Then, in other words, the nitrogen can circulate.

BRIEF DESCRIPTION OF THE DRAWINGS

Further features and advantages of the present invention will become apparent from the following description of embodiments according to the invention with reference to the enclosed drawing. Therein it shows.

In the figures, the same components are provided with the same reference signs.

DETAILED DESCRIPTION OF THE PREFERRED EMBODIMENT(S)

Figure 1:
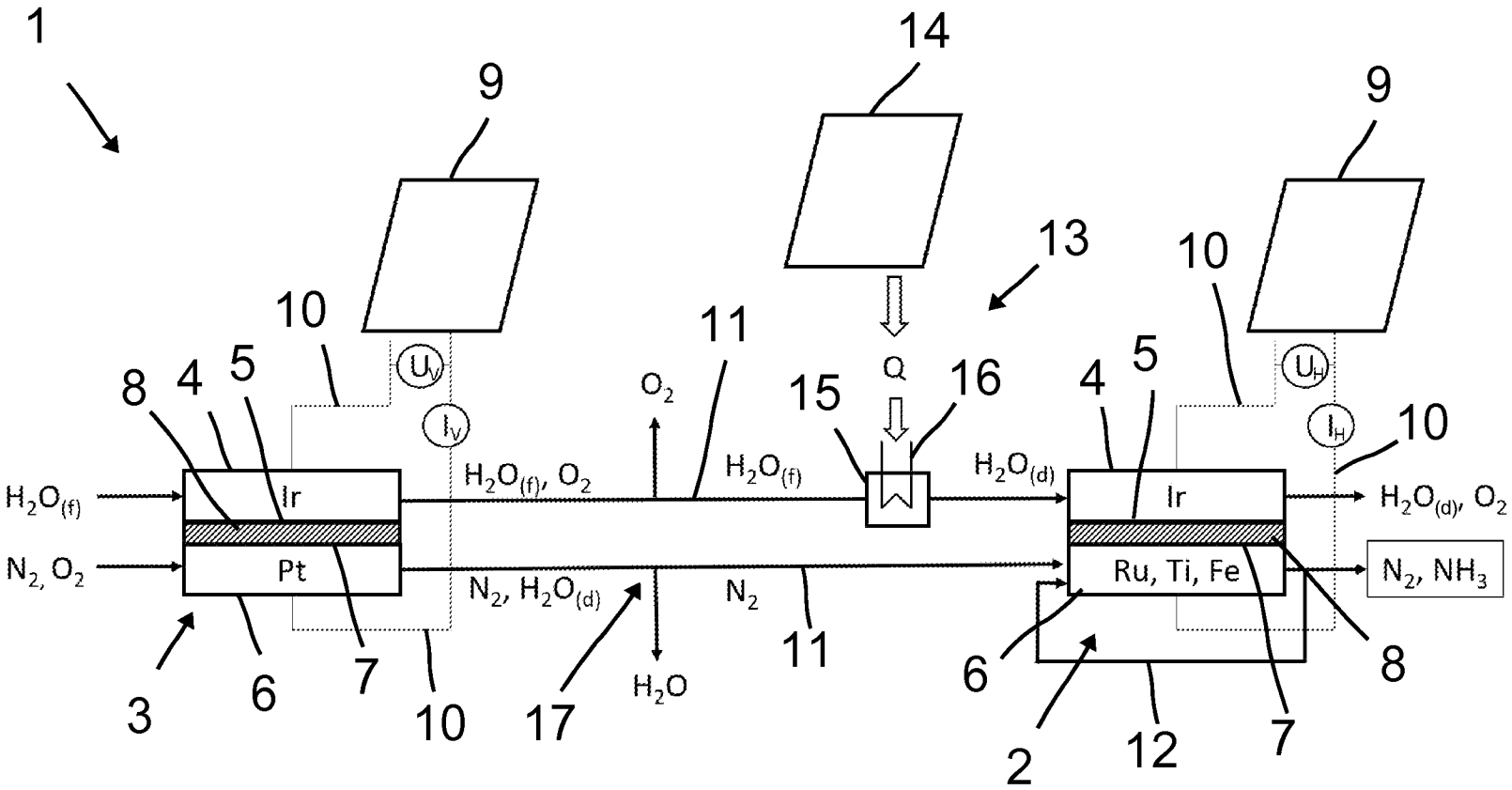
FIG. 1 a purely schematic representation of a first exemplary embodiment of an apparatus according to the invention, comprising two electrochemical cells.

FIG. 1 shows in purely schematic representation a first example of an apparatus 1 for ammonia synthesis according to the invention, which comprises a main electrochemical cell 2 and a electrochemical pre-cell 3 connected upstream thereof.

The main cell 2 has an anodic half-cell 4 with an anode 5 and a cathodic half-cell 6 with a cathode 7. The two half-cells 4, 6 each define a reaction space in their interior and each have at least one inlet and at least one outlet, which are not visible in the purely schematic figure.

A cation exchange membrane 8 is arranged between the anodic 4 and the cathodic half-cell 6 of the main cell 2, which separates the two half-cells 4, 6 from each other and through which protons can pass from the anodic 4 into the cathodic half-cell 6 of the main cell 2 during operation. The anode 5 and cathode 7 are each pressed onto opposite sides of the membrane 8. The membrane 8 is a polymer membrane comprising nafion.

Both the anode 5 and the cathode 7 each have at least one catalyst material. In the embodiment shown, the anode 5 has Iridium Ir as the catalyst material, and the cathode 7 has Ruthenium Ru and Titanium Ti and Iron Fe.

Main cell voltage means for providing a main cell voltage $U_H$ between the anode 5 and the cathode 7 of the main cell 2 are further provided, which in the present case are given by a photovoltaic cell 9. The photovoltaic cell 9 is connected to the anode 5 and the cathode 7 via electrical conductors 10.

The electrochemical pre-cell 3 of the apparatus 1, which is connected upstream of the electrochemical main cell 2, is constructed completely analogously to the main cell 2, and accordingly also comprises an anodic half-cell 4 with an anode 5 and a cathodic half-cell 6 with a cathode 7, and a cation exchange membrane 8, which is arranged between the anodic and the cathodic half-cells 4, 6 and separates the two half-cells 4, 6 from one another. The two half-cells 4, 6 of the pre-cell 3 also each define a reaction space in their interior and each have at least one inlet and at least one outlet, which cannot be seen in the purely schematic figure. The membrane 8 of the pre-cell 3 also comprises nafion.

The anode 5 and the cathode 7 of the pre-cell 3 each have at least one catalyst material. The catalyst material of the anode 4 is iridium, again analogous to the main cell 2. A difference between the main and pre-cells 2, 3 exists in the catalyst material of the cathode 5. The cathode 5 of the pre-cell has only one catalyst material, specifically platinum.

Associated with the pre-cell 3 is another photovoltaic cell 9 of the apparatus 1, which forms pre-cell voltage means for providing a pre-cell voltage $U_V$ between the anode 5 and cathode 7 of the pre-cell 3. The associated electrical connection is provided via conductors 10.

The apparatus of FIG. 1 further comprises fluid connection means 11 for fluidically connecting the anodic half-cell 4 of the pre-cell 3 to the anodic half-cell 4 of the main cell 2, which in the example shown comprise or are provided by at least one fluid conduit, specifically at least one tube. Fluid connection means 11 are also provided for fluidically connecting the cathodic half-cell 6 of the pre-cell 3 with the cathodic half-cell 6 of the main cell 2, which here likewise comprise or are given by at least one fluid line, specifically at least one tube.

A circulation conduit 12 is associated with the main cell 2, which fluidically connects the outlet of its cathodic half-cell 6 with the inlet of its cathodic half-cell 6 to enable circulation.

In the shown example, the apparatus 1 also comprises an evaporation device 13 connected upstream of the anodic half-cell 4 of the main cell 2, which is fluidically connected on the input side to the anodic half-cell 4 of the pre-cell 3 and on the output side to the anodic half-cell 4 of the main cell 2. The evaporation device 13 comprises a solar thermal collector 14, a heat exchanger unit 15 and a heat transfer medium circuit 16. Heat transfer medium circulating through the circuit 16 during operation can be heated by means of the solar thermal collector 14 and release heat in the heat exchanger unit 15 in order to evaporate a liquid flowing through.

Furthermore, a separator unit 17 is provided downstream of the cathodic half-cell 4 of the pre-cell 3 and upstream of the cathodic half-cell 4 of the main cell 2. In the purely schematic FIG. 1, only a highly simplified representation of this is shown by a conduit for the drain of separated liquid which runs from the fluid connection means 11 connecting the two cathodic half-cells 6.

The apparatus shown in FIG. 1 can be used to carry out a first example of the method according to the invention. For this purpose, a pre-cell voltage $U_V$ of less than 1.23 V is applied between the anode 5 and cathode 7 of the pre-cell 3 and a main cell voltage $U_H$ in the range of 1.7 V to 2.7 V is applied between the anode 5 and cathode 7 of the main cell 2. The voltage is provided in an environmentally friendly and sustainable manner by means of the photovoltaic cells 9.

Water is supplied to the anodic half-cell 4 of the pre-cell 3 and, at the same time, nitrogen and oxygen in the form of air are supplied to the cathodic half-cell 6 of the pre-cell 3 by means of suitable conveying devices, such as pumps and/or blowers and/or compressors. In the shown example, water is supplied in liquid form. In the figure, this is indicated by a subscripted (f) after the $H_2O$. The fact that the water is in a vapor state is indicated by $H_2O_{(d)}$ in corresponding places. In the anodic half-cell 4 of the pre-cell 3, water is supplied in excess and oxygen is obtained, and in the cathodic half-cell 6 of the pre-cell 3, nitrogen and oxygen are supplied and the oxygen is reduced with protons and electrons to water. The cathode 7 of the pre-cell 3 serves as an oxygen-consuming cathode. The operating temperature in the pre-cell 3 can in particular be up to 90° C.

From the liquid water and oxygen leaving the anodic half-cell 4, the gaseous oxygen is separated, which is indicated by a branching arrow in FIG. 1, and the remaining water is evaporated in the evaporation device 13 and fed in vaporous state to the anodic half-cell 4 of the main cell 2. The evaporation is carried out using the solar thermal collector 14, i.e. by using solar energy, and is therefore also particularly environmentally friendly and sustainable.

From the nitrogen and water obtained in the cathodic half-cell 6 of the pre-cell 3, the liquid water is separated, which can be done very easily by means of the separation device 17, and the remaining nitrogen is fed to the cathodic half-cell 6 of the main cell 2, thus serving, in other words, as input for this half-cell 6. Water is fed to the anodic half-cell 4 of the main cell 2 and in an electrochemical reaction split into oxygen, protons and electrons. Water is fed in excess, therefore water and oxygen leave the half-cell 4 and in the cathodic half-cell 6 of the main cell 2 the nitrogen fed in excess reacts with protons and electrons to form ammonia. The operating temperature in the main cell 2 can in particular be about 30° C., which has proven to be especially suitable, since a particularly good performance of the cell can then be observed and the ammonia yield increases.

The ammonia produced is available for further use then. It can be fed to a storage facility.

Via the circulation pipe 12, nitrogen obtained in the cathodic half-cell 6 of the main cell 2 can be fed back to the input side of the cathodic half-cell 6 of the main cell 2 and used again as input for the latter.

Figure 2:
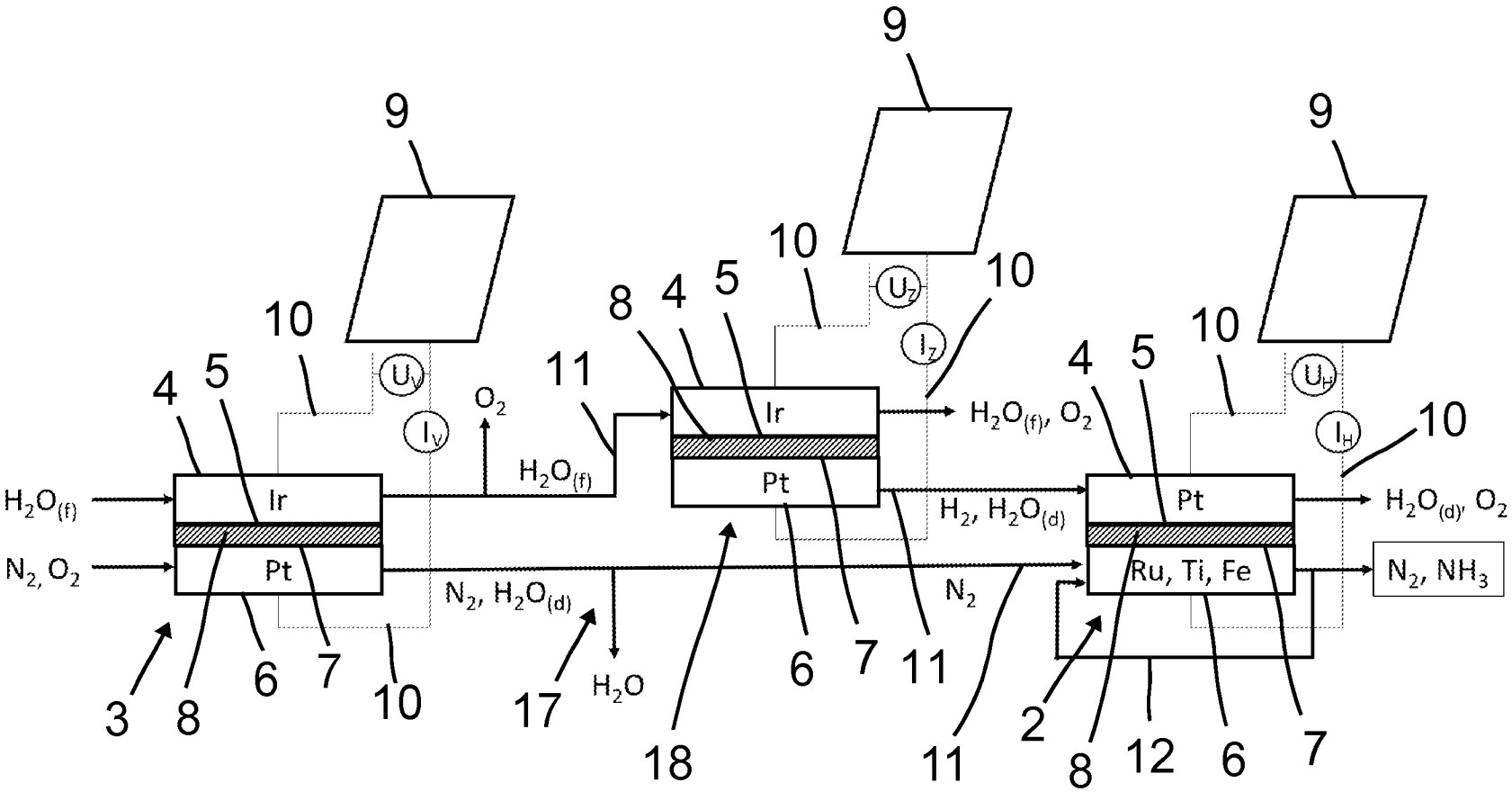
FIG. 2 is a purely schematic representation of a second embodiment of an apparatus according to the invention, comprising three electrochemical cells.

FIG. 2 shows a second embodiment of an apparatus for the synthesis of ammonia according to the invention, which differs from that according to FIG. 1 essentially in that it comprises an intermediate cell 18 downstream of the pre-cell 3 and upstream of the main cell 2, i.e. another third cell, and in that the anode 5 in the anodic half-cell 6 of the main cell 2 of this apparatus is characterized by a catalyst material other than iridium, namely platinum.

The pre-cell 3 of the apparatus of FIG. 2 is identical in construction to the pre-cell 3 of the apparatus of FIG. 1, and the catalyst materials of anode 5 and cathode 7 of the latter are also identical to those of the pre-cell 3 of FIG. 1. They are identically designed cells.

The intermediate cell 18 of the apparatus of FIG. 2 is identical in construction to the pre-cell 3 of this apparatus—and thus also to the pre-cell 3 of FIG. 1—and has the same catalyst materials, namely iridium, as far as the anode 5 is concerned, and platinum, as far as the cathode 7 is concerned. In other words, the apparatus 1 of FIG. 2 has two identical electrochemical cells, which are used differently, which will be discussed in more detail below.

Associated with the intermediate cell 18 is yet another photovoltaic cell 9, which forms intermediate cell voltage means for providing an intermediate cell voltage $U_Z$ between the anode 5 and cathode 7 of the intermediate cell 18. Here, too, the associated electrical connection is established via electrical conductors 10.

The apparatus of FIG. 2 further comprises fluid connection means for the fluid connection of the anodic half-cell 4 of the pre-cell 3 with the anodic half-cell 4 of the intermediate cell 18 and fluid connection means for the fluid connection of the cathodic half-cell 6 of the intermediate cell 18 with the anodic half-cell 4 of the main cell 2. The fluid connection means here likewise comprise at least one fluid line, specifically at least one tube, or are provided thereby.

With the apparatus of FIG. 2, a second exemplary embodiment of the method according to the invention can be carried out. For this purpose, an intermediate cell voltage $U_Z$ in the range of 1.48 to 2 V is applied between the anode 5 and cathode 7 of the intermediate cell 18. The voltage is provided in an environmentally friendly and sustainable manner by means of the photovoltaic cell 9 associated with the intermediate cell 18.

Regarding the pre-cell 3, the procedure is exactly the same as in the first embodiment described above. That is, water $H_2O$ is supplied to the anodic half-cell 4 of the pre-cell 3 and, at the same time, nitrogen $N_2$ and oxygen $O_2$ in the form of air are supplied to the cathodic half-cell 6 of the pre-cell 3. In the shown example, water is supplied in liquid form. Oxygen is obtained in the anodic half-cell 4 of the pre-cell 3 and nitrogen and water in the cathodic half-cell 6 of the pre-cell 3. The cathode 7 of the pre-cell 3 of the apparatus shown in FIG. 2 thus also serves as an oxygen-consuming cathode.

Oxygen is separated from the water and oxygen leaving the anodic half-cell 4 of the pre-cell 3, which is again indicated by a branching arrow in FIG. 2, and the remaining water is fed in liquid state to the anodic half-cell 4 of the intermediate cell 18. In contrast, nothing is fed to the cathodic half-cell 6 of the intermediate cell 18.

In the anodic half-cell 4 of the intermediate cell 18, water is fed and oxygen is created in the electrochemical reaction, and in the cathodic half-cell 6 of the intermediate cell 18, hydrogen is created in an electrochemical reaction. At the same time, water permeates through the membrane and accumulates in the half-cell 6. The operating temperature in the intermediate cell 18 can in particular be up to 90° C.

Hydrogen obtained in the cathodic half-cell 6 of the intermediate cell 18 and water obtained therein are fed to the anodic half-cell 4 of the main cell 2. On the way to the main cell 2, any liquid water can be separated or evaporated in an evaporation device.

Exactly as in FIG. 1, the cathodic half-cell 6 of the main cell is supplied with nitrogen which was obtained in the cathodic half-cell 6 of the pre-cell 3. The nitrogen can pass from the cathodic half-cell 6 of the pre-cell 3 to the cathodic half-cell 6 of the main cell 2 via the fluidic connection means 11 between these two half-cells 6. Since the intermediate cell 18 plays no role on the cathode side, one can also say that it is connected between the pre-cell and the main cell 2 on the anode side.

In the example according to FIG. 2—again in accordance with FIG. 1—oxygen is obtained in the anodic half-cell 4 of the main cell 2 and ammonia in the cathodic half-cell 6 of the main cell 2. Here, the ammonia produced is then also available for further use. It can be supplied to a storage facility.

Via the circulation pipe 12, nitrogen exiting the cathodic half-cell 6 of the main cell 2 can be fed back to the input side of the cathodic half-cell 6 of the main cell 2 and used again as input for the latter.

The illustrated embodiments of apparatuses 1 according to the invention and the embodiments of methods according to the invention carried out therein enable the solar production of ammonia from air and water. They are characterized by sustainability and environmental friendliness.

The invention claimed is:

1. A method for synthesis of ammonia, wherein an electrochemical main cell (2) comprising an anodic half-cell (4) with an anode (5) and a cathodic half-cell (6) with a cathode (7) is provided, wherein a membrane (8) is arranged between the anodic (4) and the cathodic half-cell (6), through which protons can pass from the anodic (4) into the cathodic half-cell (6), and wherein the anode (5) comprises at least one catalyst material, and the cathode (7) comprises at least one catalyst material, an electrochemical pre-cell (3), which is connected upstream of the main cell (2) and which comprises an anodic half-cell (4) with an anode (5) and a cathodic half-cell (6) with a cathode (7), is provided, wherein a membrane (8) is arranged between the anodic half-cell (4) and the cathodic half-cell (6), through which protons can pass from the anodic half-cell (4) into the cathodic half-cell (6), and wherein the anode (5) comprises at least one catalyst material, and the cathode (7) comprises at least one catalyst material, a voltage is applied between the anode (5) and cathode (7) of the pre-cell (3), a pre-cell voltage (UV), and a voltage is applied between the anode (5) and cathode (7) of the main cell (2), a main cell voltage (UH), water is supplied to the anodic half-cell (4) of the pre-cell (3) and nitrogen and oxygen are supplied to the cathodic half-cell (6) of the pre-cell (3), oxygen is obtained in the anodic half-cell (4) of the pre-cell (3) and nitrogen and water are obtained in the cathodic half-cell (6) of the pre-cell (3), water is supplied to the anodic half-cell (4) of the main cell (2), and nitrogen obtained in the cathodic half-cell (6) of the pre-cell (3) is supplied to the cathodic half-cell (6) of the main cell (2), oxygen is obtained in the anodic half-cell (4) of the main cell (2), and ammonia is obtained in the cathodic half-cell (6) of the main cell (2), an intermediate cell (18), which is connected downstream of the pre-cell (3) and upstream of the main cell (2) and which comprises an anodic half-cell (4) with an anode (5) and a cathodic half-cell (6) with a cathode (7), is provided, wherein a membrane (8) is arranged between the anodic half-cell (4) and the cathodic half-cell (6), through which protons can pass from the anodic (4) into the cathodic half-cell (6), and wherein the anode (5) comprises at least one catalyst material, and the cathode (7) comprises at least one catalyst material, a voltage is applied between the anode (5) and cathode (7) of the intermediate cell (18), an intermediate cell voltage (UZ), water is supplied to the anodic half-cell (4) of the intermediate cell (18), and oxygen is obtained in the anodic half-cell (4) of the intermediate cell (18), and hydrogen and permeating water are obtained in the cathodic half-cell (6) of the intermediate cell (18), and hydrogen and water obtained in the cathodic half-cell (6) of the intermediate cell (18) are supplied to the anodic half-cell (4) of the main cell (2).

2. The method according to claim 1, wherein water taken from the anodic half-cell (4) of the pre-cell (3) is supplied to the anodic half-cell (4) of the main cell (2).

3. The method according to claim 1, wherein the anode (5) of the main cell (2) comprises platinum as catalyst material.

4. The method according to claim 1, wherein the intermediate cell voltage (UZ) in the range of 1.2 to 2.5 volts is applied.

5. The method according to claim 1, wherein solar energy is used to provide the intermediate cell voltage (UZ), and wherein the intermediate cell voltage (UZ) is provided by at least one photovoltaic cell (9).

6. The method according to one of the preceding claim 1, wherein the pre-cell voltage (UV) of less than 1.7 volts is applied, and/or in that the main cell voltage (UH) in the range of 1 to 3 volts is applied.

7. The method according to one of the preceding claim 1, wherein solar energy is used for providing the pre-cell voltage (UV) and/or for providing the main cell voltage (UH), wherein the pre-cell voltage (UV) and/or the main cell voltage (UH) is provided by at least one photovoltaic cell (9), wherein the pre-cell voltage (UV) is provided by the at least one photovoltaic cell (9) associated with the pre-cell (3) and the main cell voltage (UH) is provided by a further photovoltaic cell (9) associated with the main cell (2).

8. The method according to claim 1, wherein the water is separated from the nitrogen and water obtained in the cathodic half-cell (4) of the pre-cell (3).

9. The method according to claim 1, wherein vaporous water is supplied to the anodic half-cell (4) of the main cell (2), wherein an evaporation device (13) connected upstream of the main cell (2) is used to obtain the vaporous water, and wherein the evaporation device (13) comprises at least one solar thermal collector (14) or is coupled to at least one solar thermal collector (14).

10. The method according to claim 1, wherein nitrogen exiting from the cathodic half-cell (6) of the main cell (2) is supplied again to the cathodic half-cell (6) of the main cell (2).

11. An apparatus (1) for synthesis of ammonia, comprising:

an electrochemical main cell (2) comprising an anodic half-cell (4) with an anode (5) and a cathodic half-cell (6) with a cathode (7), wherein a membrane (8) is arranged between the anodic half-cell (4) and the cathodic half-cell (6), through which protons can pass from the anodic (4) into the cathodic half-cell (6), and wherein the anode (5) comprises at least one catalyst material, and the cathode (7) comprises at least one catalyst material, a main cell voltage device (9) for providing a voltage (UH) between the anode (5) and the cathode (7), an electrochemical pre-cell (3) connected upstream of the electrochemical main cell (2), which comprises an anodic half-cell (4) with an anode (5) and a cathodic half-cell (6) with a cathode (7), wherein a membrane (8) is arranged between the anodic half-cell (4) and the cathodic half-cell (6), through which protons can pass from the anodic (4) into the cathodic half-cell (6), and wherein the anode (5) comprises at least one catalyst material, and the cathode (7) comprises at least one catalyst material, a pre-cell voltage device (9) for providing a voltage (UV) between the anode (5) and cathode (7) of the pre-cell (3), a fluid connection device (11) for fluidically connecting the cathodic half-cell (6) of the electrochemical pre-cell (3) to the cathodic half-cell (6) of the electrochemical main cell (2), an intermediate cell (18), which is connected downstream of the electrochemical pre-cell (3) and upstream of the electrochemical main cell (2), and which comprises an anodic half-cell (4) with an anode (5) and a cathodic half-cell (6) with a cathode (7), wherein a membrane (8) is arranged between the anodic halfcell (4) and the cathodic half-cell (6), through which protons can pass from the anodic (4) into the cathodic half-cell (6), and wherein the anode (5) comprises at least one catalyst material, and the cathode (7) comprises at least one catalyst material, intermediate cell voltage device (9) for providing a voltage (UZ) between the anode (5) and cathode (7) of the intermediate cell (18), fluid connection device (11) for fluidically connecting the anodic half-cell (4) of the electrochemical pre-cell (3) to the anodic half-cell (4) of the intermediate cell (18), and fluid connection device (11) for fluidically connecting the cathodic half-cell (6) of the intermediate cell (18) to the anodic half-cell (4) of the electrochemical main cell (2).

12. The apparatus (1) according to claim 11, wherein the fluid connection device (11) are provided for the fluidic connection of the anodic half-cell (4) of the pre-cell (3) to the anodic half-cell (4) of the main cell (2).

13. The apparatus (1) according to claim 11, wherein the anode (5) of the main cell (2) comprises platinum as catalyst material.

14. The apparatus (1) according to claim 11, wherein the intermediate cell voltage device (9) is configured to provide the voltage (UZ) in the range of 1.2 to 2.5 volts.

15. The apparatus (1) according to claim 11, wherein the intermediate cell voltage device (9) comprise at least one photovoltaic cell (9) or are provided by at least one photovoltaic cell (9).

16. The apparatus according to claim 11, wherein the pre-cell voltage device (9) is configured to provide the voltage (UV) of less than 1.7 volts, and/or that the main cell voltage device (9) is configured to provide the voltage (UH) in the range of 1 to 3 volts.

17. Apparatus The apparatus according to claim 11, wherein the pre-cell voltage device comprises at least one photovoltaic cell (9) or are given by at least one photovoltaic cell (9), and/or that the main cell voltage device comprises at least one photovoltaic cell (9) or are given by at least one photovoltaic cell (9).

18. The apparatus according to claim 11, wherein a separating device (17) connected upstream of the cathodic half-cell (6) of the main cell (2) is provided, so that water can be separated before it reaches the cathodic half-cell (6) of the main cell (2).

19. The apparatus (1) according to claim 11, wherein an evaporation device (13) connected upstream of the anodic half-cell (4) of the main cell (2) is provided, wherein the evaporation device (13) on the input side is fluidically connected to the anodic half-cell (4) of the pre-cell (3), and/or wherein the evaporation device (13) comprises at least one solar thermal collector (14).

20. The apparatus (1) according to claim 11, wherein at least one circulation pipe (12) is provided to feed nitrogen emerging from the cathodic half-cell (6) of the main cell (2) back to the input side of the cathodic half-cell (6).

* * * * *